US006318025B1

(12) United States Patent
Sedlak

(10) Patent No.: US 6,318,025 B1
(45) Date of Patent: Nov. 20, 2001

(54) VEHICLE LIFTGATE POWER OPERATING SYSTEM

(75) Inventor: David A. Sedlak, Clarkston, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/684,198

(22) Filed: Oct. 6, 2000

(51) Int. Cl.[7] ..... E05F 11/24
(52) U.S. Cl. ..... 49/341; 296/56
(58) Field of Search ..... 49/339, 340, 341, 49/342, 275; 296/56, 146.11, 202

(56) References Cited

U.S. PATENT DOCUMENTS

| | | | | |
|---|---|---|---|---|
| 5,054,192 | | 10/1991 | Cray et al. | 29/835 |
| 5,448,856 | | 9/1995 | Moore et al. | 49/340 |
| 5,531,498 | | 7/1996 | Kowall | 296/146.4 |
| 5,588,258 | | 12/1996 | Wright et al. | 49/340 |
| 5,896,703 | * | 4/1999 | Wright et al. | 49/339 |
| 6,018,912 | * | 2/2000 | Baughman et al. | 296/56 X |
| 6,092,336 | * | 7/2000 | Wright et al. | 49/340 X |
| 6,092,337 | | 7/2000 | Johnson et al. | 49/340 |
| 6,126,222 | * | 10/2000 | Nguyen et al. | 296/56 |
| 6,142,551 | * | 11/2000 | Ciavaglia et al. | 49/340 X |
| 6,170,196 | * | 1/2001 | Kato | 49/341 X |
| 6,185,868 | * | 2/2001 | Kato | 49/339 |

* cited by examiner

*Primary Examiner*—Jerry Redman
(74) *Attorney, Agent, or Firm*—Patrick M. Griffin

(57) ABSTRACT

A power operating system opens and closes a vehicle liftgate that is pivotally attached to an aft end of a vehicle roof for pivotal movement between and open position and a closed position about a generally horizontal hinge axis. The power operating system has a gas spring strut counterbalance system and at least one drive unit that includes a reversible electric motor, a spool driven by the electric motor, a flexible web that has one end attached to the spool and an opposite end attached to the liftgate, and a pusher member that is driven by the electric motor between a retracted position and an extended position. The pusher member engages the liftgate and rotates the liftgate part way to the open position. The liftgate is closed by winding the flexible web onto the spool.

10 Claims, 3 Drawing Sheets

VEHICLE LIFTGATE POWER OPERATING SYSTEM

TECHNICAL FIELD

This invention relates to a power operating system for a vehicle liftgate that is pivotally attached to a vehicle roof for pivotal movement about a generally horizontal axis and more particularly to a power operating system for a vehicle liftgate that is equipped with a gas spring counterbalance system.

BACKGROUND OF THE INVENTION

Utility vehicles and vans with liftgates that are hinged at the top about a generally horizontal axis are used by large numbers of people today. Some of these liftgates are large and heavy. Their size and weight make some liftgates difficult to open and close. Some of the liftgates are also a great distance above the ground when they are fully opened. Their height above the ground makes them very difficult for some people to close. For these and other reasons many people would like to have a power operating system for opening and closing the liftgate.

Liftgates that have two or more gas springs for a counter balance system are common. See for instance U.S. Pat. No. 5,448,856 granted to Thomas S. Moore et al Sep. 12, 1995; U.S. Pat. No. 5,531,498 granted to David J. Kowall Jul. 2, 1996; and U.S. Pat. No. 5,588,258 granted to Kevin Wright et al Dec. 1, 1996. Gas springs in such counter balance systems generally occupy a position in which their axis is substantially parallel to the closed liftgate so that the gas springs are hidden when the liftgate is closed. In this closed position the moment arm of the gas springs is quite small. With such counterbalance systems the lift gate must be opened about one-third of the way with either manual or power assistance before the gas springs exert sufficient force to open the liftgate without the manual or power assistance.

There are even some counterbalance systems in which the gas springs pass over center and bias a liftgate toward a closed position when the liftgate is closed. With these self locking counterbalance systems, the liftgate may need to be opened more than one-third of the way before the gas springs will open the liftgate without manual or power assistance.

SUMMARY OF THE INVENTION

The object of the invention is to provide an improved vehicle liftgate power operating system for a vehicle liftgate that is equipped with a gas spring counterbalance system.

A feature of the invention is that the vehicle liftgate power operating system moves the liftgate from a closed position to a partially opened position as well as from a fully open position to a fully closed position.

Another feature of the invention is that the vehicle liftgate power operating system has a push arm that pushes the liftgate to a partially open position to assist the gas spring counterbalance system.

Still another feature of the invention is that the vehicle liftgate power operating system has a moveable push arm that can be shaped to hug the interior roof structure and consequently maximize the unobstructed load height at the liftgate opening.

Still yet another feature of the invention is that the vehicle liftgate power has a web and reel arrangement for moving the liftgate from the fully open position to the fully closed position.

These and other objects, features and advantages of the invention will become more apparent from the following description of a preferred embodiment taken in conjunction with the accompanying drawing.

BRIEF DESCRIPTION OF THE DRAWINGS

The presently preferred embodiment of the invention is disclosed in the following description and in the accompanying drawings, wherein.

DETAILED DESCRIPTION OF THE PREFERRED EMBODIMENT

Figure 2:
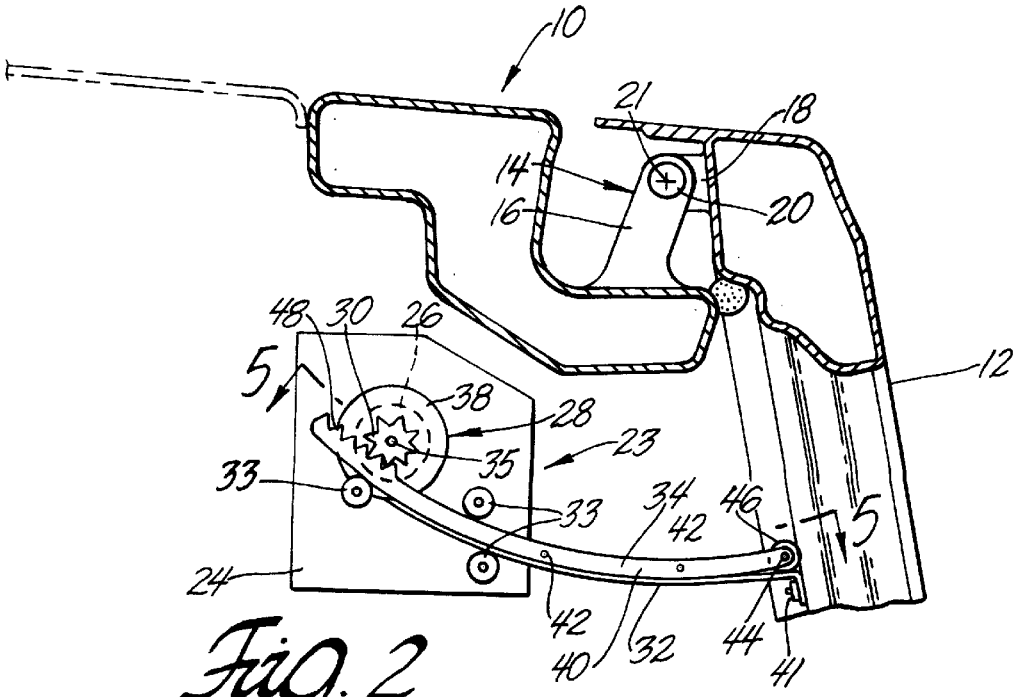
FIG. 2 is a longitudinal section of the rear portion of the vehicle of FIG. 1 showing the liftgate in a closed position.
Figure 3:
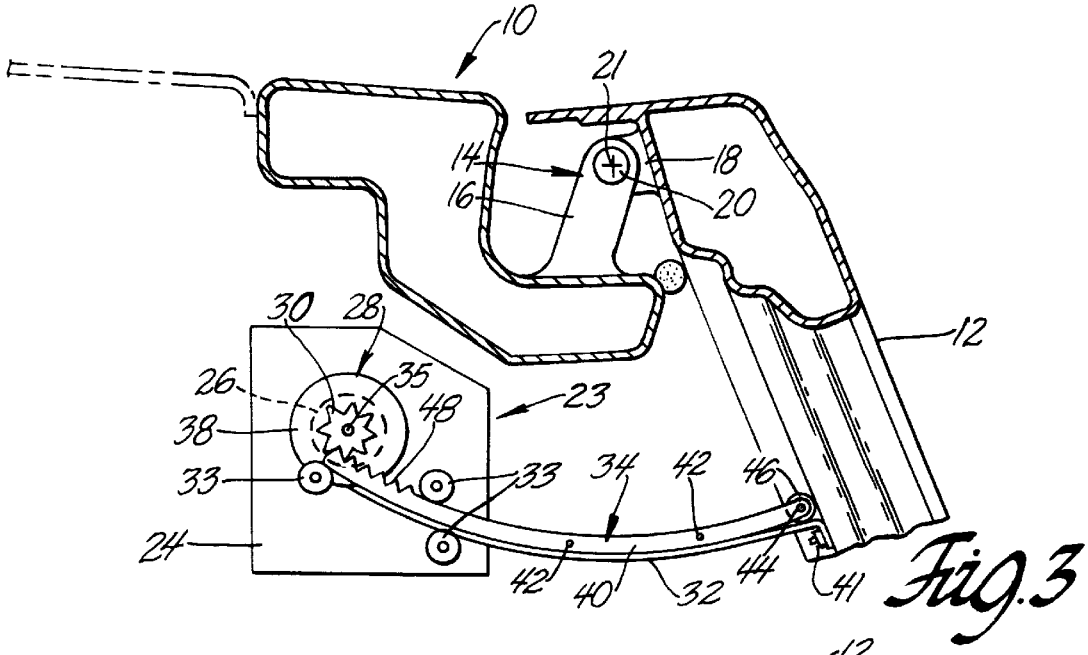
FIG. 3 is a longitudinal section of the rear portion of the vehicle of FIG. 1 showing the liftgate in a partially open position.
Figure 4:
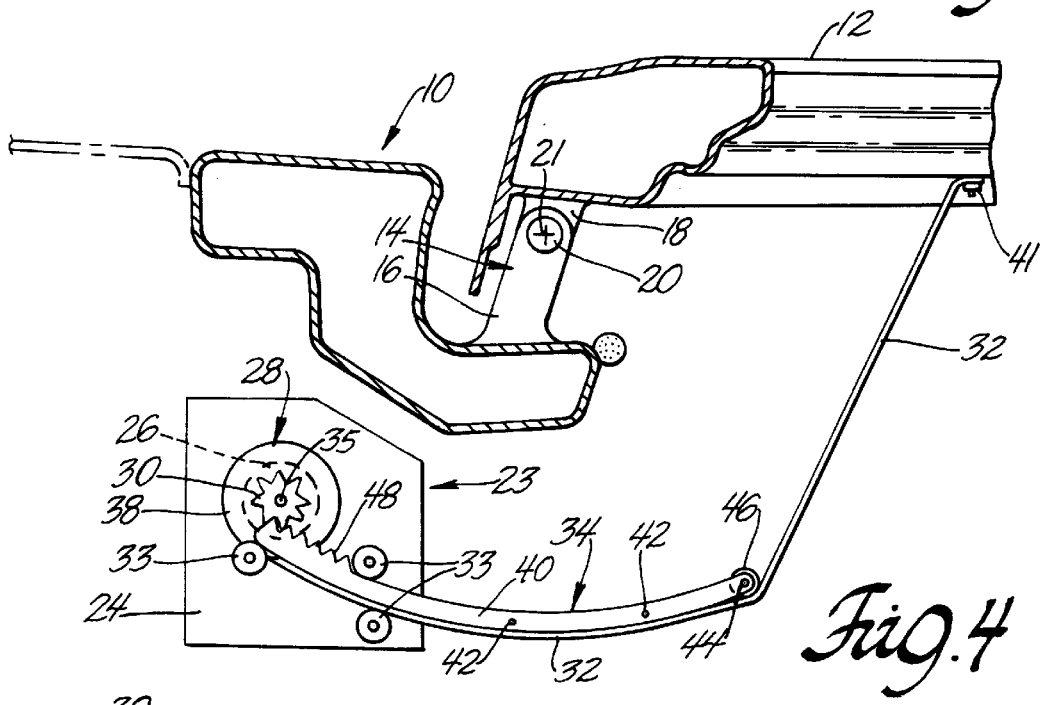
FIG. 4 is a longitudinal section of the rear portion of the vehicle of FIG. 1 showing the liftgate in the open position.

Vehicle 10 has a liftgate 12 that is attached to the aft end of the vehicle roof by two hinge assemblies. A typical hinge assembly 14 is shown in FIGS. 2, 3 and 4. Hinge assemblies 14 have hinge portions 16 that are secured to the vehicle 10 and hinge portions 18 that are secured to the liftgate 12. Hinge portions 18 are attached to hinge portions 16 by pivot pins 20 so that liftgate 12 pivots aboit a pivot axis indicated at 21 from a closed position shown in FIG. 2 to raised open position shown in FIG. 3. Pivot axis 21 is generally substantially horizontal and liftgate 12 is generally permitted to pivot about 90° about pivot axis 21. However, the range of movement can be varied substantially from one vehicle to another.

Figure 1:
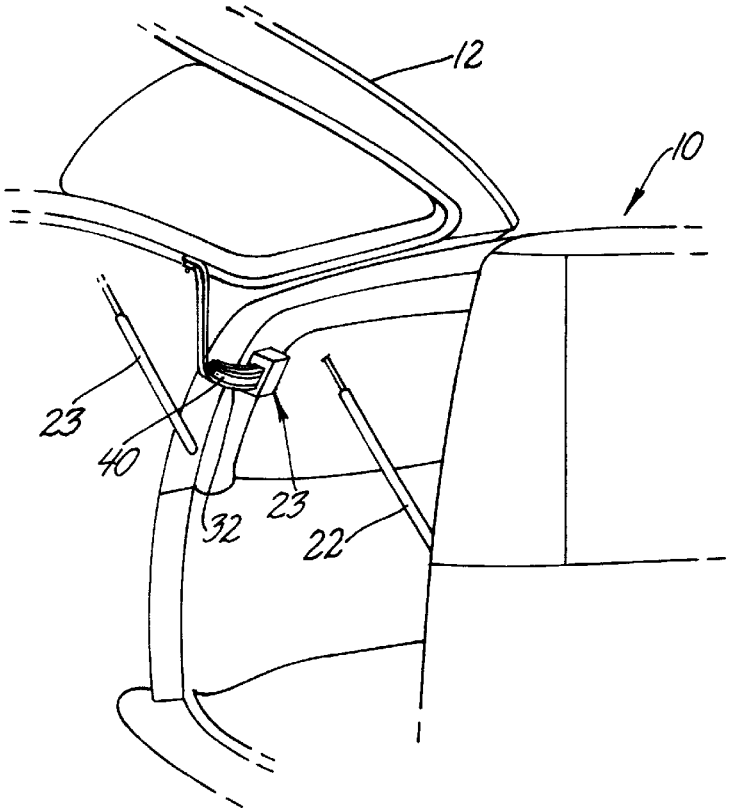
FIG. 1 is a perspective view of the rear portion of a vehicle with an open liftgate.

Lift gate 12 is opened and closed by a power operating system that preferably includes two conventional gas spring struts 22 and at least one drive unit 23. Gas spring struts 22 operate in the conventional manner to raise lift gate 12 from the closed position shown in FIG. 2 to the open position shown in FIGS. 1 and 4. Due to geometrical constraints, gas spring struts normally provide very little, if any, lifting power during the initial opening movement of the liftgate. Drive unit 23 assists in the initial opening movement of the liftgate and also operates to close the liftgate, that is move the liftgate from the open position shown in FIGS. 1 and 4 to the closed position shown in FIG. 2.

Drive unit 23 which is installed in the aft end of the vehicle roof comprises a bracket 24 that is secured to the vehicle body in a fixed position. Bracket 24 supports several parts including a reversible electric motor 26, a rotary spool 28, overrunning clutches 29 and 31, drive sprockets 30, a flexible belt or web 32, guide rollers 33 and an extendible push member 34.

Figure 5:
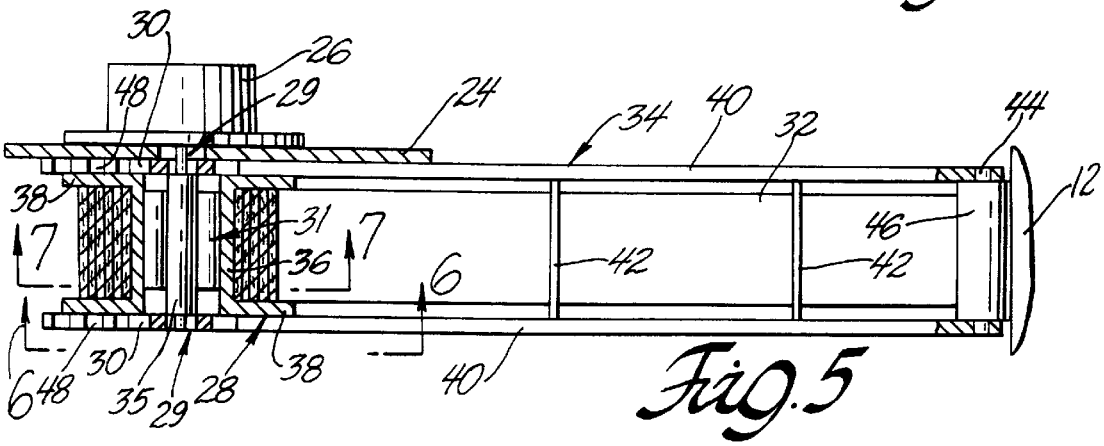
FIG. 5 is a section taken substantially along the line 5—5 of FIG. 2 looking in the direction of the arrows.
Figure 5A:
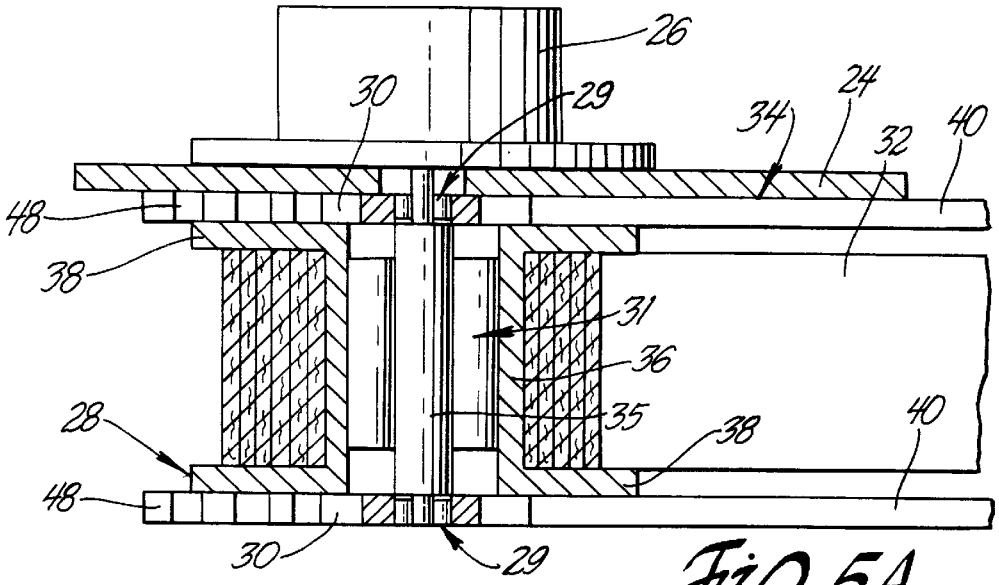
FIG. 5A is an enlargement of a portion of FIG. 5.

Reversible electric motor 26 has an output shaft 35 that drives axially spaced overrunning clutches 29 that in turn drive sprockets 30 on either side of the rotary spool 28 as best shown in FIG. 5. Output shaft 35 also drives overrunning clutch 31 that in turn drives rotary spool 28. Overrunning clutches of various types are well known. A typical overrunning roller clutch is disclosed in U.S. Pat. No. 4, 054,192 granted to Lawrence P. Johnson Oct. 18, 1977.

Output shaft 35 serves as the inner race of overrunning clutches 29 and 31. However, separate inner races can be attached to shaft 35 if desired. Drive sprockets 30 serve as the outer races for the respective overrunning clutches 29. Rotary spool 28 comprises a drum 36 and end plates 38. Drum 36 serves as the outer race of overrunning clutch 31. However, separate outer races secured to drive sprockets 30 and drum 36 can be used if desired. Clutches 29 overrun in the same direction while clutch 31 overruns in the opposite direction. Conventional overrunning roller clutch components such as cages and tickler springs have been omitted in the patent drawing for clarity.

Figure 6:
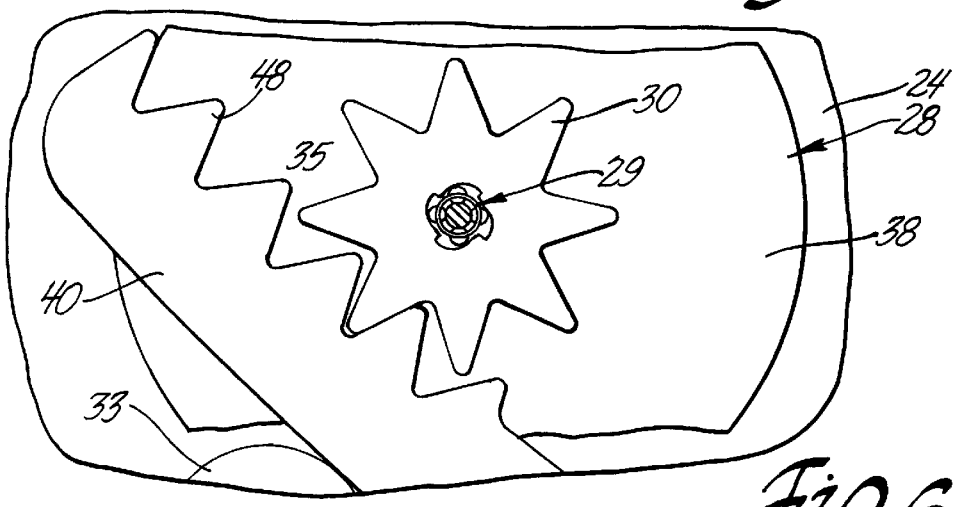
FIG. 6 is a section taken substantially along the line 6—6 of FIG. 5 looking in the direction of the arrows.
Figure 7:
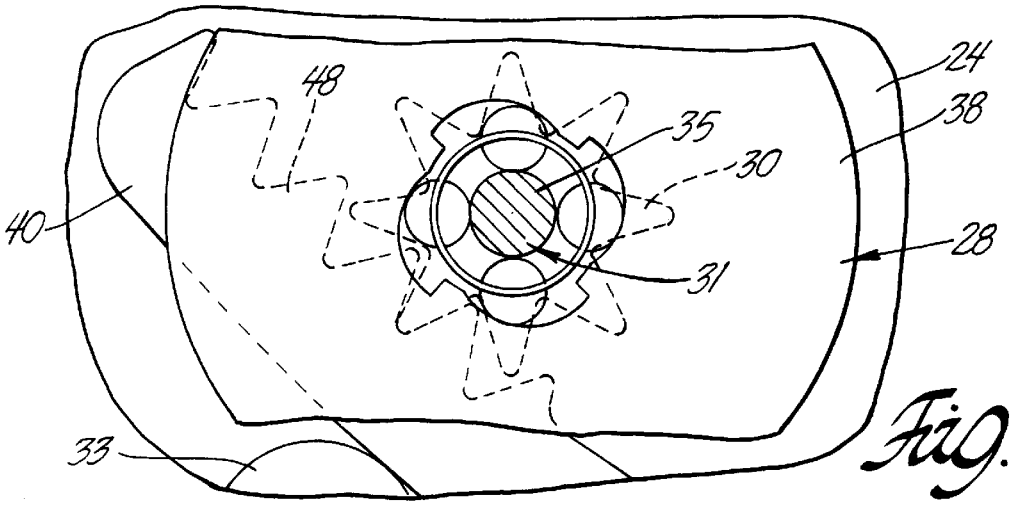
FIG. 7 is a section taken substantially along the line 7—7 of FIG. 5 looking in the direction of the arrows.

Flexible belt 32 has one end attached to the drum 36 of spool 28 and the other end attached to liftgate 12 by an anchor 41. Overrunning clutches 29 are installed as shown in FIG. 6 so that output shaft 35 drives sprockets 30 counterclockwise when shaft 35 rotates counterclockwise while allowing drive sprockets 30 to freewheel or overrun in the clockwise direction. Overrunning clutch 31 is installed as shown in FIG. 7 so that shaft 35 drives spool 28 clockwise when shaft 35 rotates clockwise while allowing spool 28 to freewheel or overrun in the counterclockwise direction. Thus belt 32 is wound onto spool 28 when shaft 35 drives spool 28 clockwise and payed off an overrunning spool 28 when shaft 35 drives sprockets 30 counterclockwise.

Push member 34 comprises two parallel arms 40 that are attached together by cross members 42 and a pin 44 at an outboard end. Pin 44 preferably carries a roller 46 for engaging liftgate 12 as explained below. Arms 40 have gear teeth 48 at their inboard ends that mesh with drive sprockets 30. Arms 40 are engaged by guide rollers 33 that guide movement of push member 34 between the retracted position shown in FIG. 2 and the extended position shown n FIG. 4. Push member 34 is retracted by belt 32 when spool 28 is driven clockwise and belt 32 is wound onto the spool. On the other hand, push member 34 is extended when drive sprockets 30 are driven counterclockwise and belt 32 is payed off of an overrunning spool 28.

The power operating system further includes a conventional power source such as the vehicle battery (not shown) and a suitable motor control for energizing and shutting off the reversible electric motor 26. Motor controls are well known to those skilled in the art and thus need not be described in detail.

The power operating system for liftgate 12 operates as follows. To raise liftgate from the closed position shown in FIG. 2 to the open position shown in FIGS. 1 and 4, the bottom of lift gate 12 is unlatched and motor 26 is energized to rotate shaft 35 counterclockwise. This engages overrunning clutches 29 and drives sprockets 30 counter clockwise and extends pusher member 38 to push liftgate 12 to the partially open position shown in FIG. 3. Pusher member 38 thus engages liftgate 12 and pivots liftgate counterclockwise providing a power assist during the initial opening movement of the liftgate where gas spring struts 22 provide very little, if any, opening force. When liftgate opens a predetermined amount such as illustrated in FIG. 3, (usually about 25 degrees), the opening force of the gas spring struts 22 is sufficient to raise liftgate 12 to the fully open position shown in FIGS. 1 and 4. During this secondary or final opening movement, belt 32 is payed off spool 28 by the freewheeling of spool 28 when being pulled by the opening tailgate 12 being rotated in the counterclockwise direction by gas spring struts 22.

To close liftgate 12, motor 26 is energized to rotate output shaft 35 clockwise. This engages overrunning clutch 31 and drives drum 36 clockwise to wind web 32 onto spool 28 which pulls liftgate 12 to the closed position shown in FIG. 2. The closing liftgate also retracts push member 34 which is permitted by the freewheeling clutches 29 between sprockets 30 and output shaft 35.

The power operating system can be designed to work with various gas spring struts counterbalance systems by varying the length or stroke of push member 34 to provide sufficient opening power until the gas spring struts take over.

The power operating system described above may include a second identical drive unit for balanced operation. It is also possible to use two drive units with a single reversible electric motor driving two output shafts for the respective drive units. Moreover, one of the clutches 29 can be eliminated by driving only one sprocket 30 in each drive unit 22 or by driving both drive sprockets 30 in each drive unit with only one clutch 29 in each drive unit. In other words many modifications and variations of the present invention in light of the above teachings may be made. It is, therefore, to be understood that, within the scope of the appended claims, the invention may be practiced otherwise than as specifically described.

What is claimed is:

1. A power operating system for opening and closing a vehicle liftgate that is pivotally attached to an aft end of a vehicle roof for pivotal movement between and open position and a closed position about a generally horizontal hinge axis, comprising in combination;

a gas spring strut counterbalance system having at least one gas spring strut that is pivotally attached to the vehicle and to the vehicle liftgate for opening the vehicle liftgate; and at least one drive unit that includes motor, a spool driven by the motor in a wind-up direction, a flexible web that has one end attached to the spool and an opposite end attached to the liftgate, and a pusher member that is driven by the motor to an extended position when the spool is driven by the motor in an opposite direction, the pusher member when extended engaging the liftgate and rotating the liftgate during an initial opening movement of the liftgate.

2. The power operating system as defined in claim 1 wherein the pusher member has a roller at an outboard end for engaging the vehicle liftgate.

3. The power operating system as defined in claim 2 wherein the web engages the roller when the lift gate is in the open position.

4. The power operating system as defined in claim 1 wherein the pusher member has teeth at an inboard end that engage a drive sprocket driven by the motor via an overrunning clutch.

5. The power operating system as defined in claim 4 wherein the overrunning clutch driven by the motor overruns in one direction and wherein the spool is driven by the motor via an overrunning clutch that overruns in an opposite direction.

6. A power operating system for opening and closing a vehicle liftgate that is pivotally attached to an aft end of a vehicle roof for pivotal movement between and open position and a closed position about a generally horizontal hinge axis, comprising in combination;

a gas spring strut counterbalance system having at least one gas spring strut that is pivotally attached to the vehicle and to the vehicle liftgate for moving the vehicle liftgate to the open position; and at least one drive unit for moving the vehicle lift gate part way to the open position and to the closed position, the at least one drive unit including;

a reversible electric motor, a spool driven by the electric motor in a wind-up direction via an overrunning clutch when the electric motor rotates in the one direction, a flexible web that has one end attached to the spool and an opposite end attached to the liftgate, and a pusher member that is driven by the electric motor to an extended position via a second overrunning clutch when the electric motor rotates in an opposite direction, the pusher member when extended engaging the liftgate and rotating the liftgate part way to the open position.

7. The power operating system as defined in claim 6 wherein the at least one drive unit includes a sprocket that is driven by the second overrunning clutch, and wherein the pusher member has teeth at an inboard end meshing with the sprocket.

8. The power operating system s defined in claim 7 wherein the overrunning clutch overruns in one direction and the second overrunning clutch overruns in an opposite direction.

9. The power operating system as defined in claim 8 wherein the electric motor drives an output shaft and wherein the spool, the overrunning clutch, the second over running clutch and the sprocket are all coaxial with the output shaft.

10. The power operating system as defined in claim 6 wherein the overrunning clutch overruns in one direction and the second overrunning clutch overruns in an opposite direction.

* * * * *